US005647589A

United States Patent [19]

Kurandt

[11] Patent Number: 5,647,589

[45] Date of Patent: Jul. 15, 1997

[54] FULLY AUTOMATIC DEVICE FOR REMOVAL OF SPOT SAMPLES

[75] Inventor: Fritz Kurandt, Berlin, Germany

[73] Assignee: System Kurandt GmbH, Germany

[21] Appl. No.: 589,340

[22] Filed: Jan. 22, 1996

[30] Foreign Application Priority Data

Jan. 20, 1995 [DE] Germany ..... 195 02 676.4

[51] Int. Cl.[6] ..... B65H 3/24; B65H 3/26

[52] U.S. Cl. ..... 271/280; 73/863.91; 414/788.5

[58] Field of Search ..... 198/418.8; 73/863.91, 73/863.92, 864.31; 221/67, 134; 271/280, 282, 285; 414/788.5; 493/37

[56] References Cited

U.S. PATENT DOCUMENTS 4,607,536 8/1986 Lawson et al. ..... 73/863.91
4,932,647 6/1990 Svensson ..... 271/280

FOREIGN PATENT DOCUMENTS 1-150642 6/1989 Japan ..... 271/280

*Primary Examiner*—Karen B. Merritt
*Assistant Examiner*—Janice L. Krizek
*Attorney, Agent, or Firm*—Young & Basile, P.C.

[57] ABSTRACT

A device which enables fully automatic removal of spot-check samples from unfolded cartons, and predetermines, by means of a counting and marking unit, a precise selected stack quantity from a travelling endless stack disposed in a scale-like configuration, so that they can be combined into a truss at the end of the scale stack. The device comprises a conveyor belt upon which the endless stack is transported in an oblique scale-like configuration at variable speed, a vertically-adjustable hold-down bar defining the stack height, a sensor scanning the stack height, at least one optical measuring arrangement for the position at any moment of a carton, a gripper disposed on a travelling gripper carriage for spot-check sampling, a magazine for receiving the removed spot-check samples and a pusher marking a folded carton.

9 Claims, 5 Drawing Sheets

FULLY AUTOMATIC DEVICE FOR REMOVAL OF SPOT SAMPLES

BACKGROUND OF THE INVENTION

The invention relates to a fully-automatic device for removal of spot-check samples for removing pre-folded cartons or similar flat articles from a travelling endless stack in a scale-like configuration, with a predetermined precise stack quantity. The mass production of precisely-measured quantities of foodstuffs and luxury foods as well as medicines and the like requires a corresponding mass production of packaging materials, of which folded cartons form a high proportion. The quality and predictability of such folded cartons and their imprints are subject to exacting requirements. They are produced at high manufacturing speeds and in an exactly reproducible fashion on modern assembly lines using on-line technology. Folded cartons and similar paperboard articles are pre-stamped from paperboard and printed. The flat carton blanks are disposed by folding and gluing in the form of arrangements of flat cartons in an endless stack in a shingle- or scale-like configuration, and passed through various measurement and monitoring points. Spot-check samples are removed. The cartons are finally combined, packed in stacks of a specific number and dispatched.

The high production performances and demanding quality requirements made of the packaging products render necessary special monitoring systems during the manufacturing procedure, which are scarcely economically feasible by means of manual intervention in the manufacturing sequence, as this lacks technical logic, and involves the unavoidable possibility of error where monitoring personnel are involved.

In this respect, the sample removal which is regarded as particularly critical is that which is subject to specific criteria of removal which cannot be guaranteed by manual intervention by a monitoring person, and the number, precisely predeterminable to one unit, of product units packed into stacks and brought on to the market.

SUMMARY OF THE INVENTION

The object of the present invention, lying within this problematic area, is to design the removal of spot-check samples of flat articles such as folded cartons or the like, transported in an endless scaled flow, in accordance with all the criteria necessary for this purpose, and also to predetermine the removal of selected quantities of cartons at the end of the manufacturing process, and precisely to the single unit.

By virtue of the fact that the gripper used for spot sampling is in associated movement, for and during the sampling procedure, with the scale-like disposition of the endless stack, thus a motor-driven gripper is used. On the one hand various speeds at which such a scaled stack may be moved on a conveyor belt may be compensated for, but also the sampling procedure itself may be so reliably designed that precisely the desired sample is reliably removed, without any deformation of its immediate environment in the stack, and for example passed to a sample magazine. A particular advantage in this respect is that sampling can be done without singling out the articles, which move in a flow in a shingle-like configuration; a hold-down bar located in the removal area and precisely defining the stack height, ensures precisely defined removal conditions.

The sequences of movements are coordinated to one another in an optimum way so that samples may be removed from the stack flow at only short intervals, and also at wide spacings, depending on the conditions predetermined by programmable software for fully-automatic sampling.

In addition to simple sampling, it is possible by means of the counting and marking unit, which is advantageously installed at the extreme end of the manufacturing line in order to exclude any possibility of error, to dispatch precise packages which contain a precise required number of flat cartons or similar flat articles. By means of partial ejection, the marking unit precisely marks, for example, every hundredth, five hundredth or even ten thousandth folded carton, and thus precisely the start and end of the stack. Removal and marking may be adjusted to the respective oblique angle of the travelling scale flow, and their sequences of movement may be precisely coordinated to those of the stack.

BRIEF DESCRIPTION OF THE DRAWINGS

The invention will now be described by way of example in the form of an advantageous embodiment, and with reference to the annexed drawings, which show.

DESCRIPTION OF THE PREFERRED EMBODIMENT

Figure 1:
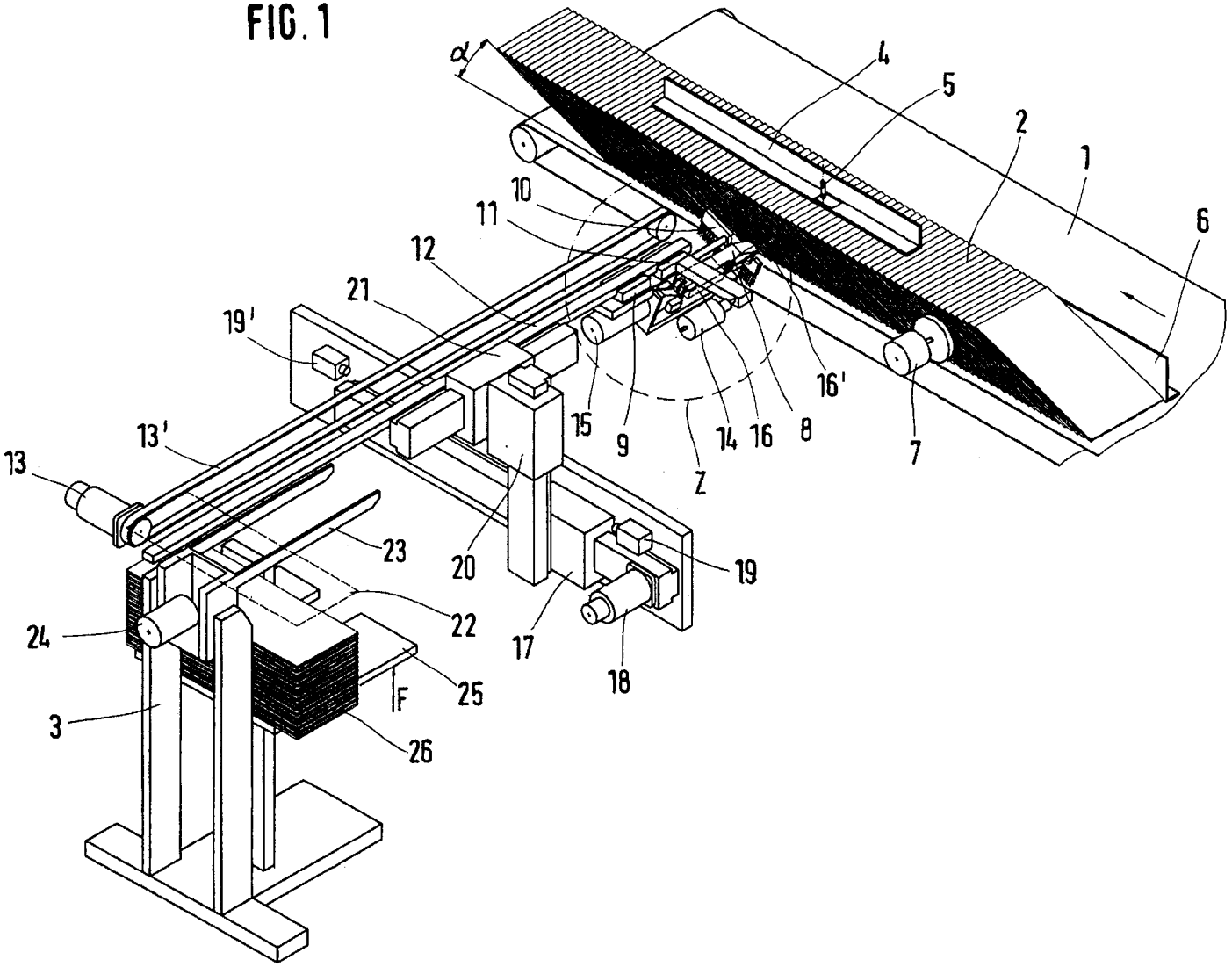
FIG. 1 is an overall front view of the fully automatic sampling system according to the invention.
Figure 2:
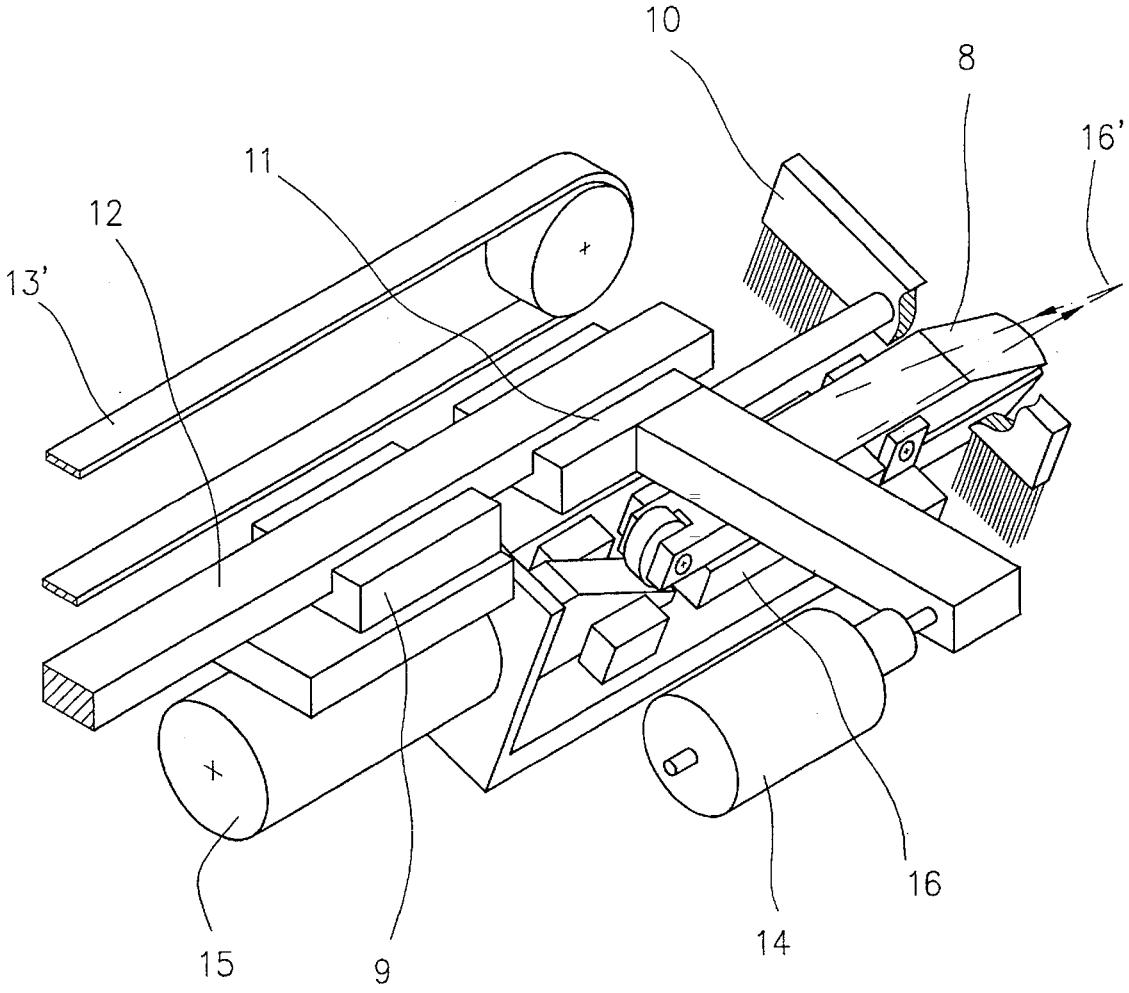
FIG. 2 is an enlarged detail from FIG. 1.
Figure 3:
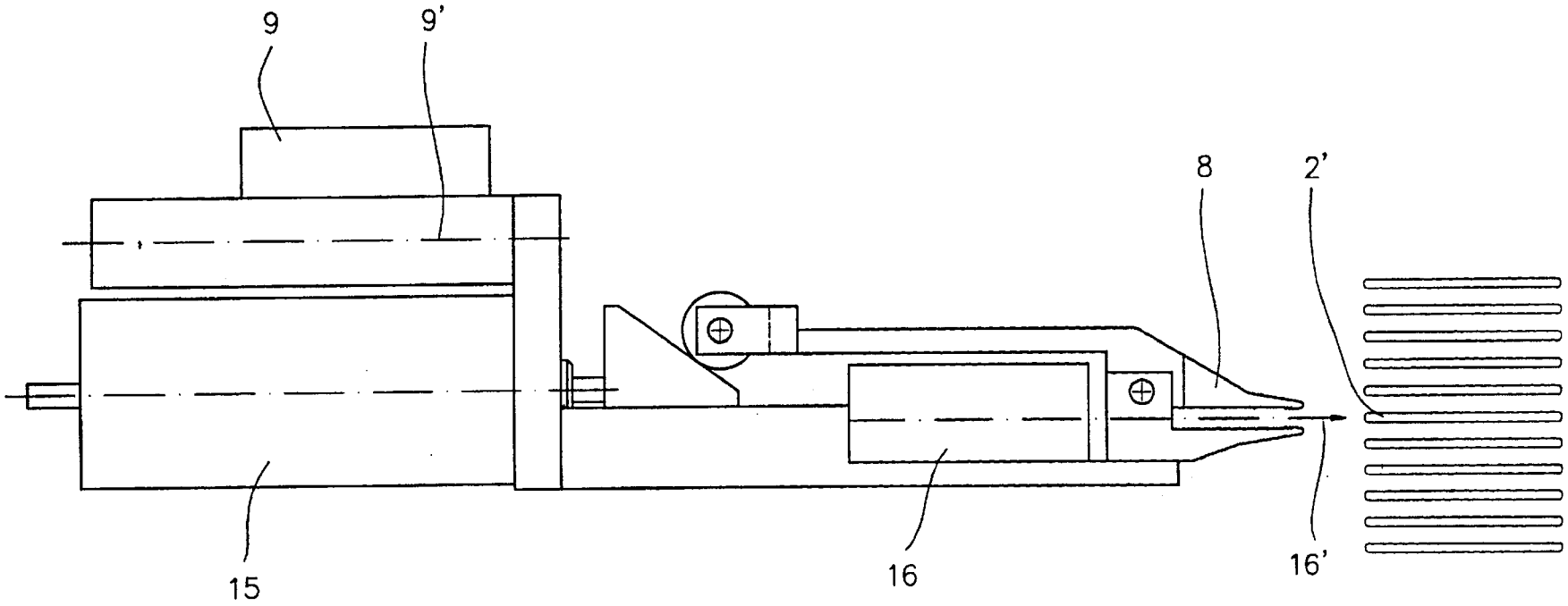
FIG. 3 is a side elevation of the gripper.

The sampling apparatus according to FIGS. 1 to 4 makes it possible to extract from a stack of flat articles, in this case flat cartons 2, moving past on a conveyor belt 1 with variable Speed, one single folded carton 2' as a spot-check sample, and to deposit it in orderly fashion in a magazine 3. The shape and alignment of the scale-like stack is not altered thereby, so that fault-free processing of the remaining folded cartons in subsequent process steps is ensured.

The height of the scale-like stack is precisely defined by a vertically-adjustable hold-down bar 4. In this respect use is made of the property of the folded cartons, which are freshly glued in terms of the predetermined manufacturing sequence, to spring up due to their internal tension. The intensity of this internal resilient force depends among other things on the shape of the carton, and on the thickness of the material of the respective type of carton.

The hold-down bar 4 defines a uniform angle (a) over the entire sampling area, and causes the fold ridges to expand until a clearly measurable difference results between the backs of cartons and the gaps between said cartons in the sequence of cartons. A sensor 5 connected to the hold-down bar 4 recognizes the presences of a scale-like stack of sufficient height.

A bar 6, serving as a stop means and disposed perpendicularly to the conveyor belt, prevents undesired deformation of the scaled stack, even when slight mechanical forces are exerted on the scaled stack transversely to the direction of travel.

The speed of the conveyor belt 1 at any moment is detected by a shaft encoder 7.

A mechanically-operating apparatus is available for removal of the folded cartons, comprising a gripper 8 for removing a spot-check sample, a travelling gripper carriage 9 with the gripper motor 15 and the feed means 16 and a stripper 10 for restraining adjacent cartons during removal. The apparatus further comprises a movable stripper carriage with the stripper 10 and a drive device 14, guide rails 12 for the travelling carriages and the drive device 13, 13' for the gripper carriage, a drive device 15 for the gripper 8, a measuring system 16 with optical measuring beam 16', which are integrated into the gripper 8, a traveller arrangement 17 for the entire spot-check sampling system 8 . . . 16, a drive device 18 for the traveller arrangement 17, and finally a travel-restricting means 19' for the drive device.

By means of a vertical adjustment means 20 and a horizontal adjustment means 21, the entire system 8 . . . 16 is adjusted in such a way that the folded cartons 2 lie within the measurement range of the measuring system 16, and within the grasping range of the gripper 8. By means of a mechanical rotating device now shown, the gripper 8, the measuring system 16 and the stripper 10 are rotated in common through the angle (a) so that, like the folded cartons, they lie at the same scale angle.

The spot-check-sampling apparatus according to FIG. 1 is started by an external electronic signal. After emission of the start signal, the entire system 8 . . . 16 is accelerated by the drive device 18 to a speed slightly less, for example 10% less than the conveyor belt speed at that moment detected by the shaft encoder 7. This results in a small degree of relative speed between folded cartons 2 and the system 8 . . . 16, particularly between the folded cartons 2 and the gripper 8 with the measuring system 16.

The gripper and the measuring system 16 are strictly associated with one another mechanically so that a carton 2' detected by the measuring beam 16' lies precisely in the narrow gripper opening of gripper 8. After detection of the back of a carton, the gripper carriage 9 is advanced by the drive device 13 and 13' until the gripper penetrates into the scale stack, and the detected carton comes to lie in the gripper.

Due to the small relative speed between the folded carton to be gripped and the gripper, sufficient time is available for penetration into the scale stack to allow this to be controlled by normal technical means.

The shape of the gripper 8 is so selected that the cartons adjacent to the grasped carton are not gripped. The counter-bar 6 prevents deviation of the scale stack perpendicularly to the direction of travel of the conveyor belt 1.

The gripper 9 is closed by the drive device 15, so that the detected carton is mechanically clamped. The gripper jaws are so shaped that, due to projecting teeth, they engage interlockingly with the carton, and thus adopt an efficient mechanical connection. The ensuing imprint traces can be used as a sign of removal by the spot sampling system.

Simultaneously with the advance of the gripper carriage 9, the stripper 10 is advanced by the drive device 14 against a mechanical stop. Upon subsequent extraction of the gripped folded carton by retraction of the gripper carriage 9, the stripper prevents the adjacent cartons from being pulled along also.

During advance of the gripper and during the gripping procedure, the entire system 8 . . . 16 moves at the synchronized or slightly slower speed. After a sample carton has been extracted, this associated movement is no longer necessary. While the gripper carriage is still on its way to the magazine, the direction of travel of the drive device 18 is reversed, and the entire system moves rapidly back to its departure position. Simultaneously with this reversal of travel, the stripper carriage 10 is retracted by the drive device 14.

As the gripper carriage 9 travels in the direction of the magazine, the entire gripper carriage with the grasped folded carton located therein is rotated into a horizontal position about the axis 9'. By this means the folded cartons, irrespective of their original scale angle (a), all lie in the same position when deposited in the magazine. The rotation is achieved by a corresponding guidance 12 of the gripper carriage, or by similar measures. As the carriage returns, there is an automatic reversion to the predetermined scale angle (a).

The gripper carriage 8 is stopped at a specific position above the magazine 3. The gripper is opened by the drive device 15 and retracted by the drive system 13, 13' until the folded carton 22 is released. An arrangement not illustrated prevents the released carton 22 from dropping immediately downwards.

By means of a lifting arrangement 23 with drive system 24, the folded carton 22 released by the gripper is pressed down on to the lift plate 25 of the magazine 3. A counter-spring not illustrated produces a counterforce F, by which the lift plate 25 is permanently pushed upwards. The lifting path of the lifting arrangement 23 is of such dimensions that the pressed-down folded carton passes a photo-electric barrier before return of the lifting arrangement takes place. Thus the carton remains in a lower position after the lifting arrangement has reverted to its basic position.

The latter procedure takes place at the end of each removal cycle, so that gradually an ordered stack 26 comprising removed spot-check samples is formed. At a given point in time the magazine 3 may be removed along with the stack of spot-check samples 26 from the entire apparatus, in order to re-stack the said samples in an appropriate container. Just as advantageous is a construction in which the cartons are deposited in an appropriate new packaging instead of in a magazine.

The structure of the sampling system is such that it may be associated with any folded-carton gluing machine at will, or may be mounted thereon, without mechanical alterations to the gluing machine being necessary.

The method of operation and installation design of the folded-carton gluing machine is totally independent of the spot-check sampling system. There is no mutual interdependence.

A factor of substantial importance for spot-check sampling is counting of folded cartons 2 which pass in a scale-like configuration on a conveyor belt 1 at a continuous but variable speed without the necessity for the cartons, as was previously conventional, to be signed out. Ejection, also termed "kicking out" of a specific folded carton 2' from a scale stack, in order thus to obtain a counting aid for manual packing in correct numbers into boxes, or for the correct spot-check sample, is closely connected to the method of operation described above. Here also it was previously only possible to carry out this procedure by means of previous singling. The ordered position of the folded cartons must not be influenced by the "kicking-out."

In order to obtain clearly measurable differences between the backs of folded cartons and the gaps between cartons, the cartons are restricted and the hold-down bars 4 are spring-loaded. An optical measuring device 35, accommodated in a common housing 30 with its optical measuring beam 35', as previously described, is capable of differentiating the passing backs of cartons from the gaps. This information can be passed on to an electronic evaluation station 36; the passing cartons are counted and thus for example the overall number of the cartons which have passed is determined, or the point in time for taking a spot-check sample is fixed.

The counting procedure may also be used regularly to initiate an ejection procedure after a specific predetermined number of cartons, said procedure pushing or kicking out a carton 2' by a certain distance (5 . . . 10 mm). The purpose of this measure is to simplify manual packing in cartons in the correct number of units, or to make this at all possible, as the cartons arrive in a rapid sequence of up to approximately 20 units per second, and visual counting is impossible at this speed. A quantity of fifty or a hundred cartons is selected for example as a kick-out frequency.

In contrast to prior art, in which singling of the cartons was necessary, the kick-out procedure can take place at the very end of the manufacturing line. The folded cartons, after the gluing procedure effected at the start of the manufacturing process, may lie exactly aligned one above the other for a relatively long period, in order to harden without displacement.

Kicking-out is effected by a pusher 37, which is precisely guided by a linear guidance system 38 and is propelled by a drive unit 39. The drive unit is of such dimensions that the ejection and retraction movements are executed extremely rapidly. This rapidity of movement is necessary for several reasons. On the one hand care must be taken that the carton 2' detected by the measuring beam 5' is moving at the speed of the conveyor belt, and is therefore located in the region of the measuring beam for a short period (a few milliseconds). On the other hand, the adjacent cartons **2*a* and 2*b* should not be touched by the pusher 37, as otherwise they would be moved along also. The cartons 2*a* and 2*b* are naturally held together with the carton 2'** by friction. The kick-out movement must therefore be so rapid that due to mass inertia the adjacent cartons are not moved also.

Figure 6:
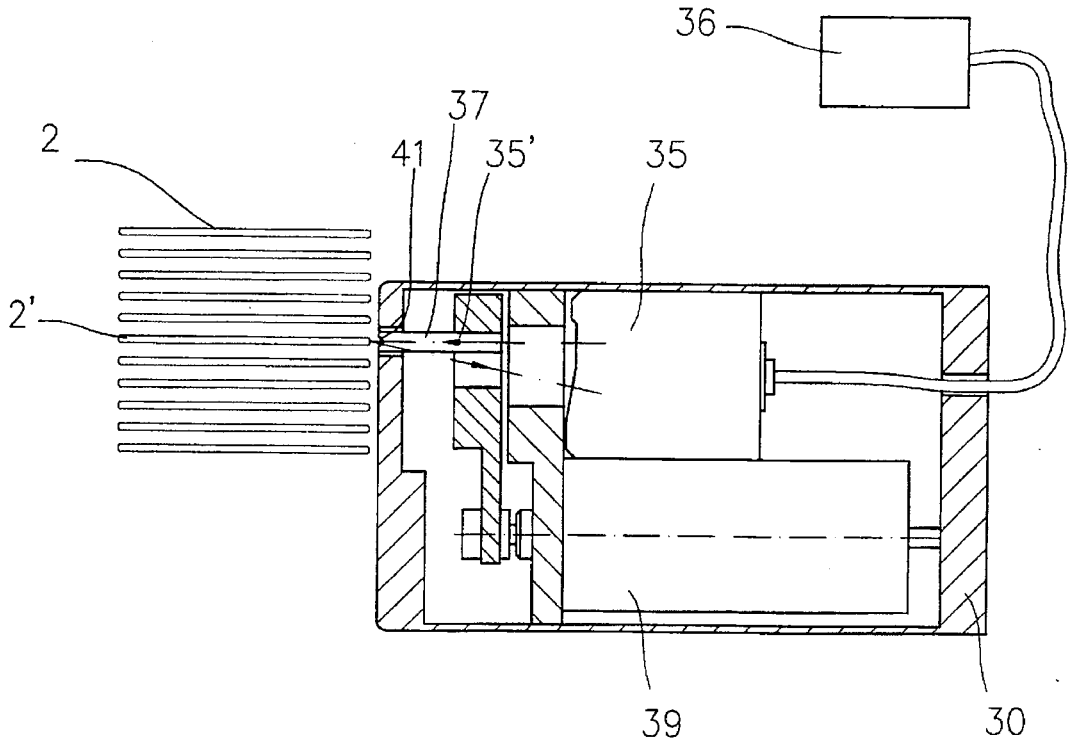
FIG. 6 is a plan view of the apparatus, in cross-section and in its basic position.
Figure 7:
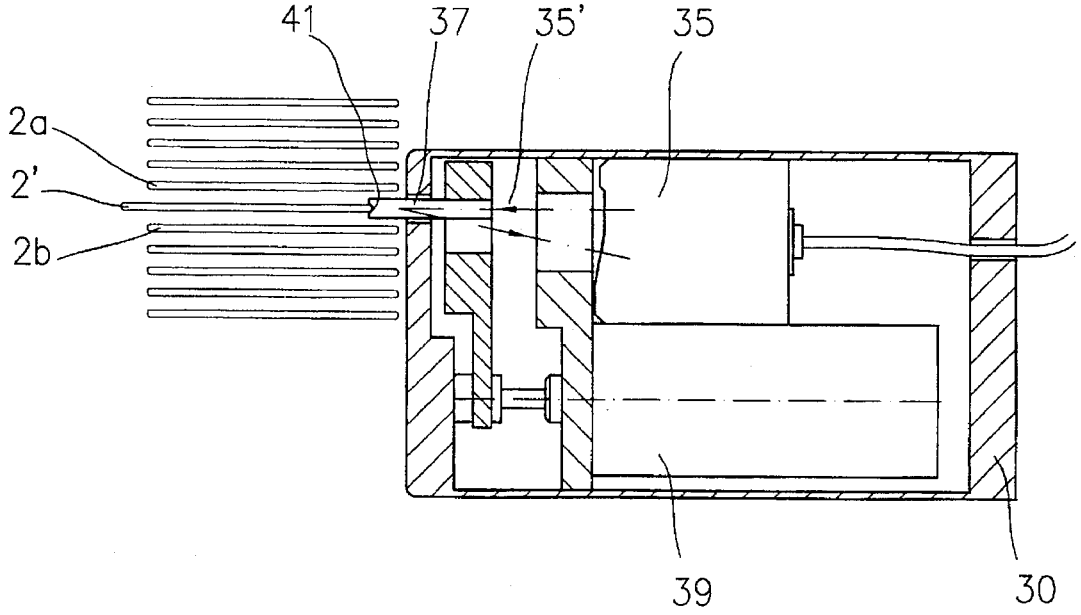
FIG. 7 is the plan view according to FIG. 4 in the operative position of the apparatus.

In order to enable the carton 2' detected by the measuring beam 35' and to be kicked out to coincide precisely with the pusher 37, the optical measuring system 35 and the pusher 37 are aligned relative to one another so that, as FIG. 6 shows, the measuring beam 35' extends precisely centrally with respect to the pusher 37.

Figure 4:
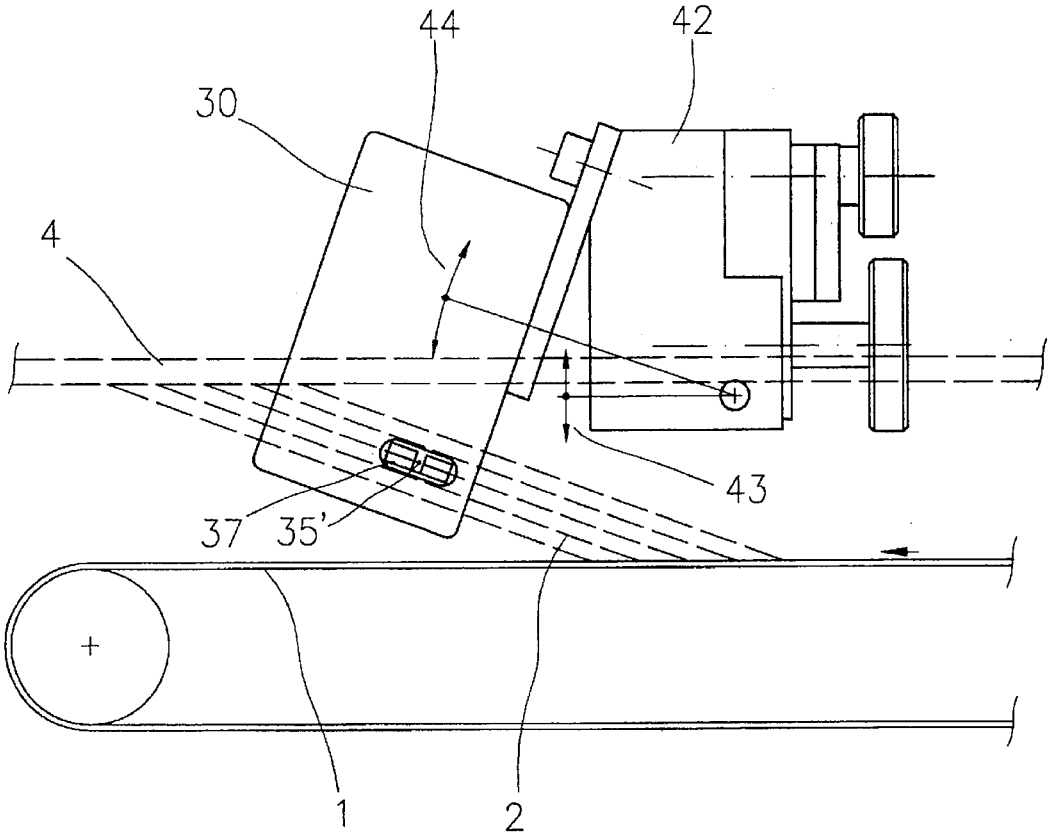
FIG. 4 is the front view of the counting and marking unit with setting arrangement.
Figure 5:
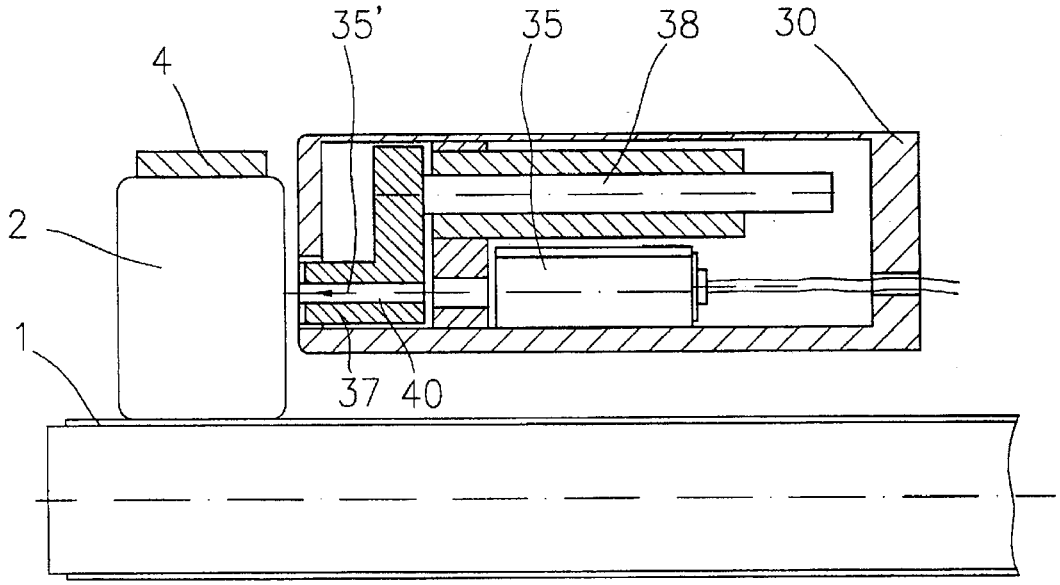
FIG. 5 is a side elevation of the apparatus in cross-section according to FIG. 4.

It will moreover be seen from FIGS. 4 and 5 that the measuring beam 35' passes through an opening 40 provided centrally in the pusher 37; thus the pusher is constructed symmetrically about the measuring beam. In order to prevent the carton 2' from breaking away laterally, the pusher 37 is provided with a central chamfer 41. With the aid of the setting device 42 shown in FIG. 4, the entire unit may be adjusted at the height 43 about an angle 44 to the position of the respective folded cartons.

What is claimed is:

1. A fully automatic apparatus for removing pre-folded cartons and similar flat articles from a moving stack of cartons in a scale-like configuration, comprising a conveyor belt, upon which the endless stack is moved in a scale-like oblique position at varying speeds, a vertically-adjustable hold-down bar defining the stack height, a sensor scanning the stack height, at least one optical measuring apparatus for measuring the position at any moment of the back of a carton, a gripper located on a movable gripper carriage for removal of a spot-check sample, the angular position of the gripper being adjustable with respect to the helix angle of the scale-like configuration of the stack of cartons, wherein the movable gripper carriage for removal of spot samples is moved in dependence on the speed of the conveyor belt transporting the pre-folded cartons, a counter-bar for preventing undesirable deformation of the stack, and a magazine for receiving the removed spot-check sample.

2. The apparatus according to claim 1, wherein the back of a folded carton can be recorded and evaluated by the optical measuring apparatus.

3. Apparatus according to claim 2, wherein the optical measuring apparatus is connected to an electronic evaluating unit for counting the cartons.

4. The apparatus according to claim 1, wherein the folded cartons are counted and, in order to combine them into a truss at the end of the scaled stack of folded cartons, exactly one folded carton may be pushed out by a rapidly-moving pusher at the end of a preselected counting procedure.

5. The apparatus according to claim 4, wherein the folded carton detected by a measuring beam and impacted by the pusher is pushed out over a short distance transversely to the direction of movement of the traveling endless stack, without altering the position of the preceding and succeeding carton in the direction of movement.

6. The apparatus according to claim 1, wherein the associated movement, of the gripper carriage and the gripper is slightly less than the speed of movement of the conveyor belt.

7. The apparatus according to claim 1, wherein the optical measuring system is integrated in the gripper.

8. The apparatus according to claim 1, wherein a spot-check sample measuring system is displaceable horizontally and vertically.

9. The apparatus according to claim 1, wherein a stripper is associated with the gripper.

* * * * *